US007195474B1

(12) United States Patent
Summers

(10) Patent No.: US 7,195,474 B1
(45) Date of Patent: Mar. 27, 2007

(54) ARTICULATED POTTER'S WHEEL

(76) Inventor: Donald E. Summers, 5107 99th St. SW., Mukilteo, WA (US) 98275

( * ) Notice: Subject to any disclaimer, the term of this patent is extended or adjusted under 35 U.S.C. 154(b) by 351 days.

(21) Appl. No.: 10/958,516

(22) Filed: Oct. 4, 2004

Related U.S. Application Data

(60) Provisional application No. 60/508,494, filed on Oct. 4, 2003.

(51) Int. Cl.
*B28B 1/02* (2006.01)

(52) U.S. Cl. ..... 425/263; 425/459; 264/39; 264/633; 264/679

(58) Field of Classification Search ..... 425/263, 425/459; 264/39, 633, 679
See application file for complete search history.

(56) References Cited

U.S. PATENT DOCUMENTS 4,102,622 A * 7/1978 Simpson ..... 425/459
4,368,021 A * 1/1983 Ryckman ..... 425/265
5,783,123 A * 7/1998 Edwards et al. ..... 264/39

* cited by examiner

*Primary Examiner*—Yogendra N. Gupta
*Assistant Examiner*—Thu Khanh T. Nguyen
(74) *Attorney, Agent, or Firm*—Todd N. Hathaway

(57) ABSTRACT

An articulated potter's wheel assembly in which the height and angle of the potter's wheel is adjustable relative to the user. A motor-driven wheel is mounted to an upper frame assembly that is adjustable for height, with the wheel being mounted at the front of the frame so as to be pivotable about a horizontal axis. The wheel is mounted to a pivotable table assembly that includes the motor and drive mechanism for the wheel. The height of the upper frame assembly is adjusted relative to a second, lower frame assembly by a motor driven jackscrew. A tank is also mounted on the upper frame assembly for dispensing water to aid in working the clay. A strap attaches proximate the pivot points of the table so as to pass across and support the user's back. The assembly may be configured as a free-standing unit or for wall-mount installation. The assembly accommodates wheelchairs, and can be used in standing or sitting positions.

21 Claims, 4 Drawing Sheets

ARTICULATED POTTER'S WHEEL

RELATED APPLICATIONS

This application claims the benefit of U.S. Provisional Patent Application No. 60/508,494 filed on 4 Oct. 2003.

BACKGROUND a. Field of the Invention

The present invention relates generally to potter's wheels, and, more particularly, a potter's wheel having an articulated structure that is adjustable for improved ergonomics and other benefits.

b. Related Art

Pottery work, although of ancient origin, continues in the modern day as both a profession and hobby. Pottery studios are increasingly popular, and the art is taught in many schools as well. Moreover, the therapeutic and rehabilitative benefits of pottery work (e.g., for persons recovering from neurological or physical injuries) are becoming increasingly recognized.

Despite the ongoing popularity of pottery work, potter's wheels themselves have remained little changed over the centuries. Traditional kick wheels have been largely replaced by electric motors, but the rest of the structure remains much the same: A low-set rotating wheel mounted on a vertical shaft in a fixed frame or cabinet. While the very simple, basic character of this design may appeal to traditionalists, it has significant drawbacks that have long plagued users. One of the most serious is the stress that is placed on a user's back: The potter must lean over the wheel and bear downwardly against it with his hands, all the while maintaining a constant position, which places a significant strain on the back. Although this may be of little concern to the young and very fit, and while certain other individuals of a stoic bent might actually maintain that it is a benefit, the reality is that for the great majority of users the back strain involved in working with traditional potter's wheels is a source of annoyance at best and an outright barrier at worst. For example, the degree of back strain encountered with ordinary wheels is simply unacceptable for many persons who are undergoing rehabilitation (many of whom in fact suffer from back injuries), and also for the elderly who may wish to enjoy the hobby in their retirement. Even for a user of average age and physical condition, the constant back strain is tiring and detracts from both the enjoyment and the amount of time that can be spent working at the wheel.

Another drawback, particularly significant when using potter's wheels for rehabilitation work, is the difficulty in accessing traditional wheels when confined to a wheelchair. In many instances it is physically impossible to move the wheelchair to a position where the person can actually reach the clay and work it on the wheel. In a few instances specialty potter's wheels have been produced for wheelchair-bound users, which feature a wheel mounted on a raised platform with adjoining armrests. This makes access from a wheelchair possible, but the user must still lean forward and strain downwardly against the wheel. Moreover, these specialized devices are generally unsuitable for use by persons who are not confined to a wheelchair, and consequently are limited in their utility.

Furthermore, even individuals who enjoy full mobility may wish to work at the potter's wheel while seated and standing at different times. Conventional potter's wheels provide no way of accommodating this change in height, and due to the size and weight of most potter's wheels it is impractical to repeatedly shift the position of the wheel between the floor and a bench or countertop. A similar problem is presented when persons of different heights want to use the same wheel but there is no way of adjusting the height of the wheel to meet their needs; for example, this is a common situation in pottery studios utilized by hobbyists, and in schools and rehabilitation facilities.

Accordingly, there exists a need for a powered potter's wheel assembly that eliminates the need to lean directly over the clay that is being worked on the wheel. Furthermore, there exists a need for such an assembly that eliminates the back stress that is commonly encountered when working traditional potter's wheels in such a position. Still further, there exists a need for such an assembly in which the wheel is readily adjustable to different heights so as to accommodate persons having different heights and also to allow persons to use the wheel whether sitting of standing. Still further, there exists a need for such an assembly in which the wheel can be readily accessed and used by a person in a wheelchair, but without limiting the usefulness of the assembly to persons who are not so confined. Still further, there exists a need for such an assembly that is durable and provides rigid support for the wheel, so as to give both satisfactory performance and long-lasting service.

SUMMARY OF THE INVENTION

The present invention has solved the problems cited above, and is an articulated potter's wheel assembly having both height and angle adjustments.

Broadly, the potter's wheel assembly of the present invention comprises: A frame having upper and lower sections; means for selectively raising and lowering the upper frame section relative to the lower frame section so as to adjust a height of the upper frame section; a motor-driven potter's wheel mounted to the upper frame section so as to be pivotable relative thereto about a generally horizontal axis, and means for selectively tilting the potter's wheel about the horizontal axis relative to the upper frame section of the assembly.

The assembly may comprise a table member having the potter's wheel and a drive motor mounted thereto, the table member being mounted to the upper frame section so as to be pivotable about the horizontal axis. The means for tilting the table member relative to the upper frame section may comprise a selectively extensible linear actuator having a first end that is mounted to the upper frame section and a second end that is mounted to a crank arm that is connected to the table member.

The means for raising and lowering the upper frame section relative to the lower frame section may comprise a jackscrew that is selectively rotatable in opposite directions by means of a motor. The jackscrew may extend vertically between the upper and lower frame sections, with the motor being mounted to one of the frame sections and the protruding end of the jackscrew being in threaded engagement with a captive nut on the other frame section.

The articulated wheel assembly may further comprise a strap member for extending around and supporting the back of the user while operating the assembly. The strap member may comprise means for dettachably connecting at least one end thereof to the upper frame of the assembly, at a location proximate the horizontal pivot axis of the table member. The support strap may further comprise means for holding the strap at a predetermined location across the user's back; the means for holding the strap at the predetermined location across the user's back may comprise hook-shaped suspension members that extend from the belt over the user's shoulders so as to support the belt therefrom.

The upper and lower frame sections may be constructed of tubular bar members. The lower frame section may comprise a base portion that extends forwardly beneath the table member that is carried on the upper frame section. The lower frame section may include a flat step plate portion located generally beneath a front of the table member, for a user to stand thereon or for a wheelchair to pass thereover.

The table member may comprise a rigid, generally planar table having a motor and drive mechanism mounted to a lower side thereof. The wheel may be selectively detachable from the motor assembly and may comprise a drive shaft that extends through the table member and is detachably received in a cooperating opening in the drive mechanism. The assembly may comprise a plurality of wheels having different sizes that are interchangeably mountable to the drive mechanism.

The table member may further comprise at least one recess for holding articles adjacent the motor-driven wheel. The assembly may further comprise a removable tray that may be selectively placed on the table member and that has a corresponding recess that interfits with the recess in the table member.

The assembly may further comprise pivot supports that are mounted to opposite edges of the table member and pivot pins that pass through cooperating openings in the pivot supports so as to form the horizontal pivot axis. The assembly may further comprise bearings mounted on the upper frame section that support the pivot pins for rotation about the horizontal axis.

The assembly may further comprise controls for selectively actuating the linear actuator and jackscrew so as to adjust the height and angle of the table member and wheel.

The assembly may further comprise a shell assembly that encloses the jackscrew and drive motor. The shell assembly may comprise upper and lower shell sections that form a vertically-sliding interfit, so that the upper shell sections are free to move vertically relative to the lower shell sections as the height of the upper frame section is adjusted.

These and other features and advantages of the present invention will be apparent from a reading of the following detailed description with reference to the accompanying drawings.

DETAILED DESCRIPTION a. Overview

Figure 1:
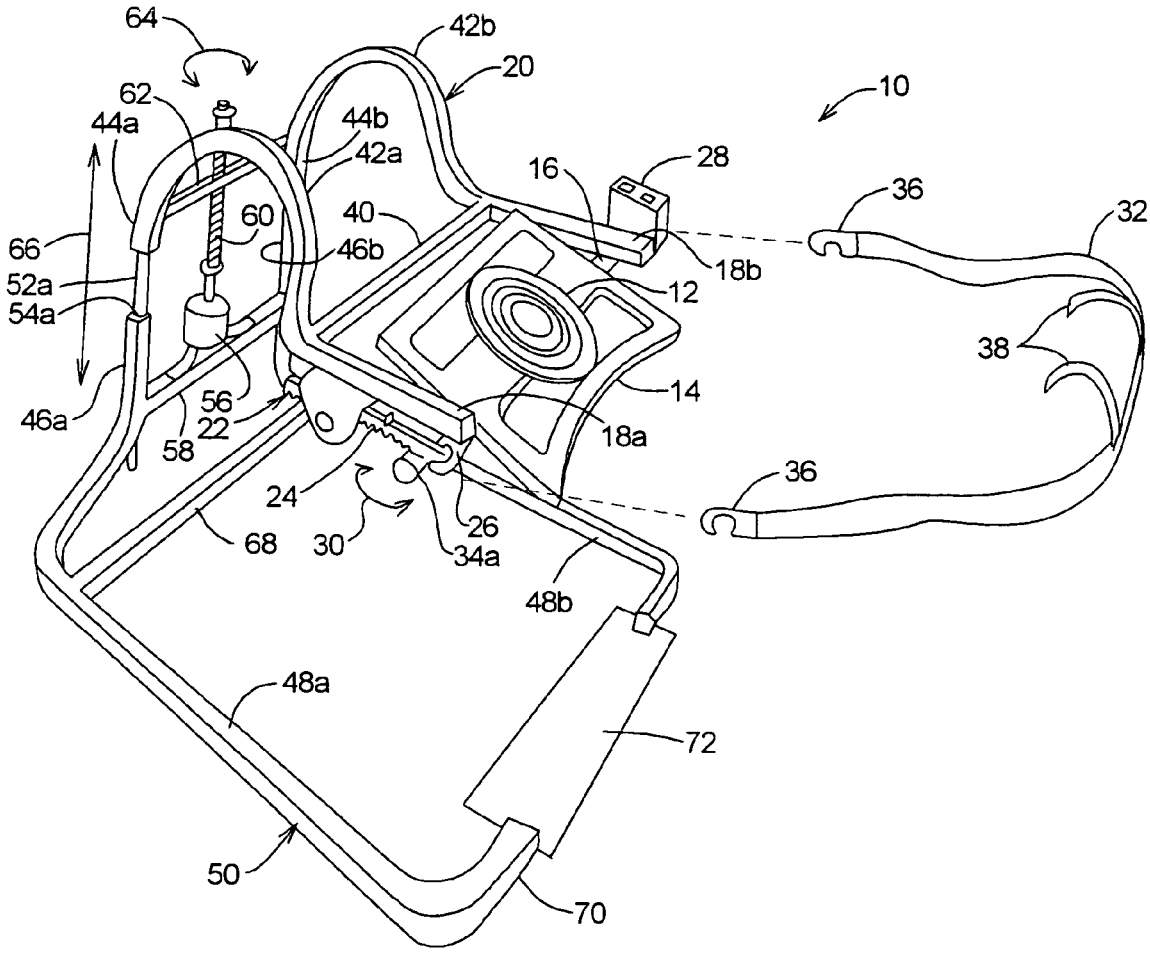
FIG. 1 is a perspective view of a an articulated potter's wheel assembly in accordance with the present invention, showing the manner in which this adjusts the height and angle of the wheel to accommodate the requirements of the user, and also the manner in which the support strap of the assembly extends around the body of the user so as to relieve back strain.

FIG. 1 shows an articulated potter's wheel assembly 10 in accordance with the present invention. As can be seen, this includes a rotating wheel 12, having a flat, circular upper surface of generally conventional shape, mounted on a table 14. As will be described in greater detail below, the wheel 12 is powered by a motor and associated drive mechanism that are likewise mounted to the table.

The table 14 is supported on a pivot shaft 16 between the forwardly-projecting arms 18*a*, 18*b* of an upper frame assembly 20. A motor-driven linear actuator 22 is mounted beneath one of the arms, and includes an extensible gear rack 24 that is mounted to the end of a cooperating pivot arm 26 on shaft 16. Accordingly, when energized (using control unit 28) the linear actuator causes the arm and shaft to rotate, as indicated by arrow 30, thereby adjusting angular orientation of the table and wheel relative to the user.

In this regard, it should be noted that an assumption underlying the configuration of most prior potter's wheels has been that the wheel must be in a horizontal orientation for proper working of the clay. The applicant herein has found that this is not the case, and that for most projects the wheel can be tilted to a significant extent without affecting the work. Moreover, in those instances where the nature of the work is such a horizontal orientation is desirable or necessary, this can be done with the articulated assembly of the present invention simply by adjusting the angle of the table using the linear actuator.

Since the angle of the table 14 and wheel 12 are adjustable the user does not have to lean over the work, which relieves a great deal of the back strain that would ordinarily be encountered. In order to further reduce stress on the back, the assembly includes a support strap 32 that extends around the user's body and detachably connects to attachment points 34*a*, 34*b* (34*a* only being visible in FIG. 1) on the frame using end clips or hooks 36. This allows the user to lean back against the strap when pressing against the work, thereby employing the muscles of the upper arms and shoulders and relieving the strain on the back.

In order to prevent the support strap from slipping down the back during use, shoulder hooks 38 are mounted to the middle portion of the strap and fit over the user's shoulders so as to suspend the strap therefrom; the shoulder hooks may be formed of molded plastic or other resilient material, suitably provided with an internal or external support (e.g., a band or a wire formed of spring steel), having sufficient rigidity to hold onto the shoulders but which is also sufficiently flexible that it can be used without discomfort. The shoulder hooks provide a comfortable form of support that is convenient and easy to use, especially by persons having restricted mobility; however, it will be understood that other forms of straps or harnesses that fit over the back and/or shoulders of the user may be employed in some embodiments.

The upper frame section 20 is suitably formed of square metal tubing having sufficient rigidity to hold the table and wheel steady and bear the downward/rearward forces that are exerted by the user. The square tubing also provides flat sides/surfaces for efficient and economical mounting of various components, such as the linear actuator, control unit, and so on. It will be understood, however, that other suitable materials having adequate rigidity and load-bearing characteristics may also be employed, such as certain high strength plastics or composite materials, for example. Furthermore, although the compound bends employed in the frame sections of the illustrated embodiment provide certain advantages in terms of load-bearing and aesthetic characteristics, a simpler configuration using 90° bends may be used as a more economical alternative.

As can be seen in FIG. 1, the two forwardly-projecting arms 18*a*, 18*b* of the upper frame assembly are substantially straight and extend generally horizontally and parallel to one another. A transverse brace bar 40 is mounted across the rearward ends of the two arms to provide increased rigidity strength when subjected to lateral forces. Rearwardly of the brace bar the two arms continue as frame bars 42*b*, 42*b* that bend upwardly and then back downwardly to define generally vertically-extending upper column portions 44*a*, 44*b*. These align vertically with corresponding upwardly-projecting lower column portions 46*a*, 46*b* of the frame bars 48*a*, 48*b* of the lower frame section 50. Guide rods 52*a*, 52*b* in the upper column portions are received in sliding engagement with the vertical bores of cooperating sleeves 54*a*, 54*b* (52*a* and 52*b* only being shown in FIG. 1) mounted in the lower column portions 46*a*, 46*b*, so as to form strong, stable, and inexpensive bushings for vertical adjustment. It will be understood, however, that other suitable forms of bushings, bearings, pistons, rams and so on may be employed in other embodiments, as well as various linkages that support vertical motion.

A drive motor 56 is mounted on a crossbar 58 between the upwardly-projecting column portions of the lower frame section, with the upper end of the output shaft being connected to a jackscrew 60; the connection may be made directly to the lower end of the jackscrew, as is shown, or the drive connection may be made via a gearbox, pulley set or other drive mechanism, depending on drive speeds, load characteristics and other design factors. The upper end of the jackscrew is in threaded engagement with a captive nut (not shown), such as a ball nut, that is mounted in a second crossbar 62 between the downwardly extending column portions of the upper frame section. The motor is reversible, so that when it is actuated (again using control box 28) this rotates the jackscrew one direction or the other, as indicated by arrow 64. The jackscrew cooperates with the captive nut to increase or decrease the distance between the upper and lower crossbars 62, 68, thus raising and lowering the upper frame section relative to the lower frame section, as indicated by arrow 66. The table and wheel, mounted at the forward ends of the upper frame section, are consequently raised and lowered by the same amount. As can be seen in FIG. 1, the lower ends of the guide rods 52*a*, 52*b* project downwardly through openings in the bars of the lower frame section, thus providing the rods with sufficient length for a full range of height adjustments, for both seated and standing users.

As can be seen with further reference to FIG. 1, the frame bars 48*a*, 48*b* diverge outwardly below the upwardly column portions 46*a*, 46*b* so as to join the generally planar base portion of the lower frame section, which is configured to rest a top a floor or other support surface. The base section includes the parallel, horizontally extending legs of the two frame rails 48*a*, 48*b*, as well as substantially coplanar cross rails 68, 70. As can be seen, the forward cross rail 70 includes a central cutout that is bridged by a flat step plate 72; the step plate (which thus replaces a section of the frame bar) provides a comfortable, flat surface on which the operator can stand while working at the wheel, with his weight thus helping to stabilize the assembly. Moreover, the flat step plate permits a wheelchair to be rolled into this area so as to gain access to the wheel, while at the same time giving the base portion of the lower frame section an adequate footprint to ensure stability during use.

Accordingly, to use the articulated potter's wheel assembly 10, an operator moves (either on foot or in a wheelchair) into a position close to the front of the table 14, with the operator's abdomen being accommodated by the concave recess 74 in the front of the table. The operator then actuates motor 56, using the appropriate switch on control box 28, so as to raise or lower the table and wheel to the desired height. The operator secures the support strap 32 around his back, and then actuates a second switch to tilt the table and wheel to the desired angle. If a different height or angle is desired, this is simply done by again actuating the switches in the manner described above. Throughout the process, the operator is able to lean back against the strap so that the downward force on the work is applied primarily using the muscles of the shoulders and arms, thus greatly reducing the strain on the back.

b. Components

Figure 2:
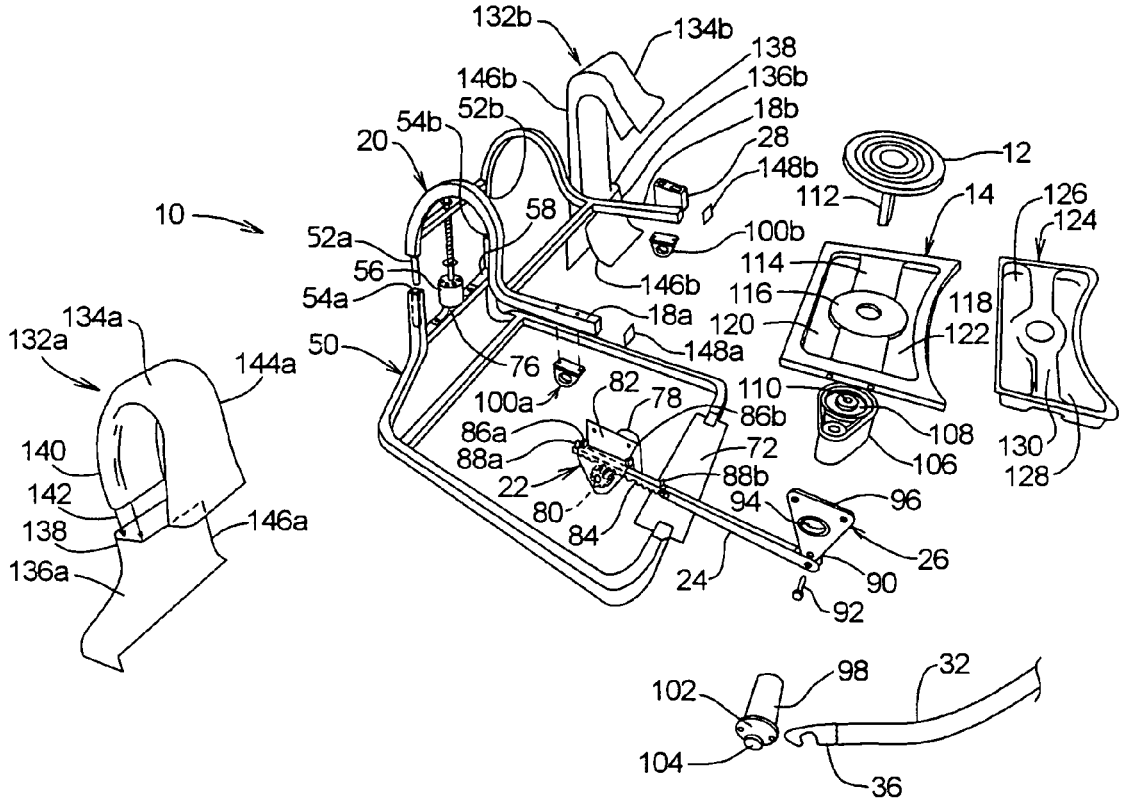
FIG. 2 is a perspective, exploded view of the articulated potters wheel assembly of FIG. 1, showing the components thereof in greater detail.

FIG. 2 shows the various components of the articulated potters wheel assembly 10 in greater detail.

As noted above, the upper and lower frame sections 20, 50 of the illustrated embodiment are preferably formed of square section steel tubing. Although any of a number of other suitable materials or configurations may be used, whether of tubular or other form (e.g., castings or panels), the square steel tubing provides the combined advantages of high strength and low cost, plus the availability of flat surfaces for convenient and stable mounting on the various operating components of the assembly. For example, the jack screw motor 56 is mounted atop the cross brace bar 58 by means of a flat bottomed bracket 76 that engages the flat upper surface of the cross brace and is secured thereto by bolts passing through cooperating bores.

Similarly, the control box 28 is mounted to the flat outer surface of the right hand forwardly projecting end 18*b* of the upper frame section, in a position where the box is easily reached by a majority of users. The housing of the control box and/or the switches themselves are preferably water resistant or waterproof so as to eliminate shock hazards when operating the switches with wet hands. Alternatively, low voltage (e.g., 12 volt) controls or other control mechanism (such as control cables or pneumatic controls, for example) may be employed. Moreover, a deployable or remote control may be provided, for example, a foot-operated switch unit.

In addition to the jackscrew motor 56, the control box also serves to actuate the motors of the linear actuator and the wheel drive. The linear actuator 22 includes a motor 78 and drive pinion that are supported on a bracket 32 from the left arm of the upper frame section. The pinion gear engages a toothed rack 84 on the actuator arm 24, so that when the motor is actuated the arm is extended or retracted as described above. The linear actuator may suitably be an off-the-shelf unit, such as are available from a number of manufacturers. The assembly includes first and second electric limit switches 86*a*, 86*b* that are actuated by stops 88*a*, 88*b* on the actuator arm, which serve to cut off power to the motor 78 so as to prevent the table and wheel from being tilted beyond predetermined limits. In addition to an electrically operated linear actuator such as that which is shown, it will be understood that other forms of linear actuators may be employed (e.g., a pneumatic or hydraulic cylinder), as well as various forms of linkages and gear trains.

The outer end of the actuator arm is mounted to a lower extension 90 of the crank arm 26 by a pivot bolt 92 that extends through cooperating bores in the two members. The crank arm includes an axle bore 94 that is located above the lower extension, and a bracket portion 96 above the axle bore that mounts to the edge of the table member 14 by means of bolts or other suitable fasteners; a corresponding pivot support (not shown) having a similar axle bore is mounted to the opposite edge of the table, but lacks the lower extension for attachment of the linear actuator.

First and second axle pins 98 (one only shown in FIG. 2) extend through the axle openings in the pivot supports and are received in rotational engagement in pillow blade bearings 100*a*, 100*b*, the latter being mounted to the bottom surfaces of the two forwardly projecting arm portions 18*a*, 18*b* of the upper frame section. The axle pins and bearings on the two sides of the table are in coaxial relationship and provide the horizontal axis of adjustment, so that as the linear actuator is extended and retracted the table and wheel are tilted one direction and other in the manner described above.

The large-diameter axle pins and bearings provide sturdy, durable supports for the table/wheel assembly, which as noted above sustains comparatively heavy loading during use. The outwardly projecting ends of the pins, on the right and left sides of the assembly, are provided with connector knobs 44 having circumferential recesses that receive and engage the end hooks 36 of the support strap 32. This provides a strong quick-attach/detach mechanism for the support belt that is located at a convenient level, and which also allows the ends of the belt to pivot slightly as the operator shifts his position; it will be understood, however, that alternative forms of attachment mechanisms, such as various buckles and clips, may be used in other embodiments.

The table member 14 provides a rigid, pivoting support for the wheel and drive motor, and is suitably formed of molded fiberglass or cast/milled aluminum alloy, or of another comparatively light, strong material. The wheel drive motor 106 and its associated belt and pulleys are mounted to the bottom of the table member by bolts or other suitable fasteners so that the entire mechanism is suspended therefrom.

In the preferred embodiment that is illustrated, the driven pulley 108 has a square center-opening 110 that receives a cooperating square cross section shaft 112 having the wheel 12 mounted to its upper end. The square opening thus forms a socket that mates with the shaft 112 in a drive relationship, but from which the shaft can be withdrawn by simply pulling the wheel upwardly. The wheel can thus be removed to facilitate cleaning of the table, and can also be quickly removed and replaced with wheels of different sizes and configurations for different sizes and types of projects; for example, when shifting to a smaller project it may be desirable to use a smaller wheel, so as to avoid having to hold and support one's forearms above the rotating surface of a larger wheel. In some embodiments splines or other forms of quick-attach/detach mechanisms may be used between the drive shaft and motor; moreover, in some embodiments the quick-attach/detach connection may be formed between the drive shaft and the wheel rather than between the drive shaft and the motor, e.g., a socket may be formed in a hub on the bottom of the wheel rather than in the pulley of the drive mechanism.

A conventional motor-and-pulley drive mechanism, providing a suitable drive ratio, has the advantages of reliability and significant cost savings. It will be understood, however, that other forms of drive mechanisms may be employed, such as direct, gear or chain drive, for example.

In the embodiment that is illustrated, the table 14 includes a full thickness crosswise beam portion 114 that spans between the pivot attachments and includes a central boss 116 beneath which the drive motor 106 is suspended, the boss having a through-opening 118 for the drive shaft 112. The crosswise beam portion is bordered on its upper and lower sides by recessed areas 120, 122 that serve to hold tools/utensils used in pottery work and also to capture and retain water/runoff from the work; drain holes (not shown) may optionally be provided in the forward, lower corners of the recess 122 and may have hoses or other drain conduits attached thereto. Also provided is an optional removable tray 124 having corresponding recesses 126, 128, as well as a raised area 140 for accommodating the beam and other raised portions of the table. The tray holds the water/runoff that is captured by the table and can be removed for periodic cleaning.

In combination with the removable wheel, and the removable tray thus facilitates cleaning and maintenance of the assembly. The tray may be formed of blow or vacuum molded plastic, stamped metal, or other suitable, relatively thin material having an easily cleaned surface.

The assembly may also include a water reservoir, such as a water tank mounted at the rear of the frame assembly, and a nozzle, pump or other dispenser mounted adjacent the table from which water can be periodically discharged onto the user's hands while working on a project.

To provide a more finished appearance, and also to enclosed the jackscrew and other moving parts at the rear of the frame sections, the assembly 10 optionally includes a rear shell assembly made up of cooperating subassemblies 32*a*, 32*b*. Each subassembly includes an upper shell section 134*a*, 134*b* that is curved to fit over and enclose the curved rearward portions of the upper frame sections 20, and a lower shell section 136*a*, 136*b* that fits over and encloses the rearward portions of the lower frame section 50. Each of the lower shell sections has an upwardly extending neck portion 138 that is sized larger than the lower end portion 140 of the corresponding upper shell section, so that the neck openings receive the upper shell sections in a vertically sliding manner, as indicated by arrows 142. Thus, as the upper frame section moves up and down to adjust the height of the assembly, the upper shell sections are free to slide up and down within the lower shell sections so as to maintain a complete enclosure without exposing any gaps between the sections.

The laterally outward edges of the shell sections generally follow the contours of the corresponding portions of the frame bars that are enclosed therein. The laterally inward edges 144*a*, 144*b* and 146*a*, 146*b*, in turn, mate along a vertically extending seam proximate the vertical center line of the assembly, thus fully enclosing both the motor/jackscrew and the sliding connections at the rear of the frame sections. The shell sections are suitably formed of a thin and light but impact resistant material, such as fiberglass, carbon fiber-resin material, or molded plastic, for example. In addition, end caps 148*a*, 148*b*, suitably formed of plastic or metal, are installed in the forwardly projecting ends of the tubular arm sections 18*a*, 18*b* to complete the finished exterior of the assembly.

c. Wall Mount Embodiment

Figure 3:
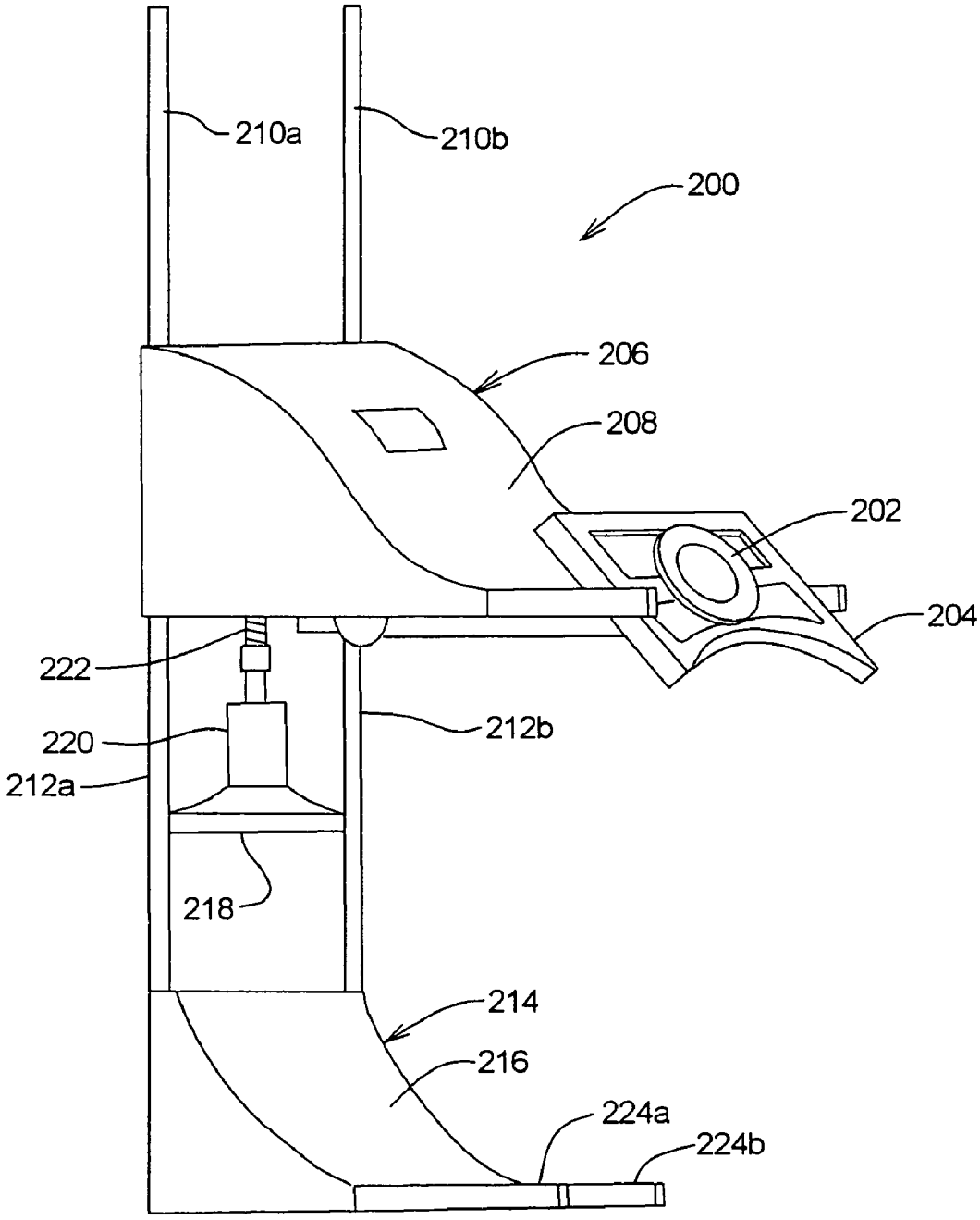
FIG. 3 is a perspective view of an articulated potter's wheel assembly in accordance with another embodiment of the invention, in which the assembly is mountable to a wall or other vertically-extending support surface rather than being a free-standing unit.

FIG. 3 shows an articulated potters wheel assembly 200 in accordance with an embodiment of the invention in which the assembly is mounted to a wall or other vertical surface, rather than being a free-standing assembly as in the embodiment described above. Wall mounting of the system is advantageous for many installations from the standpoint of space utilization, and also provides increased stability/rigidity against large loads on the wheel and tray.

Apart from the mounting and support components, the potter's wheel assembly 200 is substantially the same as that previously described. Accordingly, the assembly includes a rotating wheel 202 that is mounted on a pivoting table 204 and that is powered by a motor and associated drive mechanism. As with the embodiment described above, these components are mounted to and supported by an upper frame assembly 206, which in FIG. 3 is shown enclosed within a protective cover 208. Rather than being supported on a free-standing lower base, however, the upper frame section is supported on a pair of vertically extending rails 210*a*, 210*b* that are configured to be mounted to a wall, divider panel, or other vertical support surface. As will be described in greater detail below, the vertical rails 210*a*, 210*b* mount to the upper ends of the upwardly projecting column portions 212*a*, 212*b* of a stationary lower frame assembly 214, the latter being shown enclosed within a second housing 216. The vertical column portions correspond to the columns 46*a*, 46*b* of the embodiment described above, and similar thereto a crossbar 218 is mounted between the column portions to support a vertical drive motor 220. The drive motor raises and lowers the upper frame assembly by means of a jackscrew 222 and ball nut (not shown in FIG. 3).

The base of the lower frame section 214 is supported by first and second horizontal bars 224*a*, 224*b* that are welded or otherwise mounted to the lower ends of the columns 212*a*, 212*b*. The horizontal bars thus provide additional support and stabilization against vertical and pivoting loads exerted on the wheel/table and upper frame section during use. It will be understood, however, that the horizontal bars are somewhat optional, and that the loads may be born by other forms of legs, or in some embodiments mainly or solely by mountings that join the vertical columns 212*a*, 212*b* to the wall or other adjoining support surface.

Figure 4:
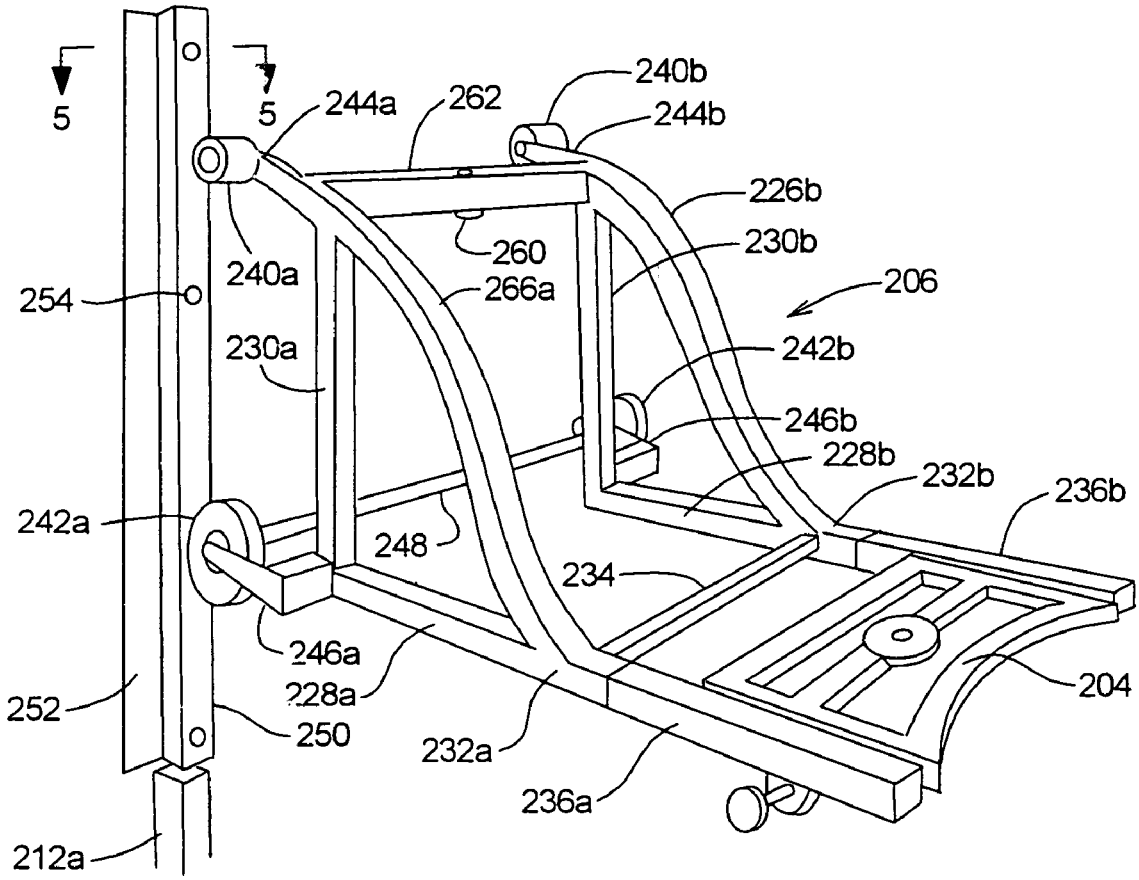
FIG. 4 is a perspective view of the upper frame of the potter's wheel assembly of FIG. 3, showing the manner in which this supports the table and wheel of the assembly from tracks that are mounted on the wall or other vertically-extending support surface.
Figure 5:
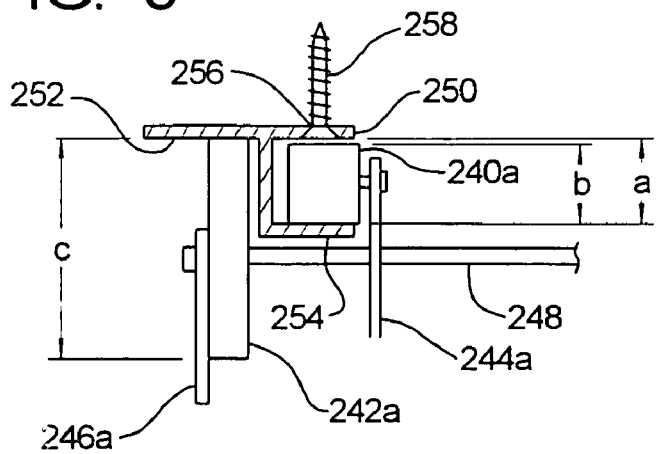
FIG. 5 is a partial, cross-sectional view of the potter's wheel assembly of FIGS. 3–4, taken along line 5—5 in FIG. 4, showing the relationship between the rollers of the upper frame and the wall-mounted tracks in greater detail.

FIGS. 4–5 show the relationship of the vertical rails and upper frame assembly in greater detail, the wheel, drive mechanism, water tank and other components being removed for ease of illustration.

Accordingly, it can be seen that the upper frame section 206 includes upper and lower forwardly extending frame bars 226*a*, 226*b* and 228*a*, 228*b* that are arranged in pairs on left and right sides of the assembly. The rearward ends of the upper and lower frame bars are vertically spaced and joined by vertically extending strut bars 230*a*, 230*b*. At their forward ends, the upper frame bars curve downwardly to junctions 232*a*, 232*b* at which they are joined to the lower frame bars 228*a*, 228*b*. A crossbar 234 is mounted horizontally between the junctions to provide additional rigidity. Forwardly projecting arms 236*a*, 236*b* extend from the conjoined ends of the upper and lower frame bars, and support the actuator, drive motor, and other components associated with the table 204, in a manner similar to the corresponding arms 18*a*, 18*b* of the assembly described above.

As can be seen with further reference to FIG. 4, the rearward side of the upper frame assembly includes paired upper and lower rollers 240*a*, 240*b* and 242*a*, 242*b*. The upper rollers 240*a*, 240*b* are sized somewhat smaller than the lower rollers, and are mounted to the rearward ends of the upper frame bars 226*a*, 226*b* on extension brackets 244*a*, 244*b*, with the axles of the rollers extending perpendicular to the forward-to-rearward planes of the frame bars. The lower rollers 242*a*, 242*b*, in turn, are somewhat larger in diameter than the upper rollers, and are mounted to the lower frame bars on rearwardly projecting extension brackets 246*a*, 246*b* that support the rollers on a common axle 248 that also extends perpendicular to the frame bars and parallel to the axis of the upper rollers 240*a*, 240*b*.

The upper and lower rollers on each side of the upper frame assembly are received in the wall-mounted vertical tracks 210*a*, 210*b* (210*a* only being shown in FIG. 4). As can be seen in FIGS. 4–5, each of the tracks includes an inwardly facing channel portion and an outwardly extending flange portion 252. Each track may suitably be formed of a section of steel angle or channel welded to a plate that forms the outer flange 252, or the track may be formed as an extrusion or other unitary component. A plurality of vertically spaced, coaxially aligned holes 254, 256 (see FIG. 5) are formed through the front and rear walls of each track. The rearward holes are sized and countersunk to cooperate with the heads of screws 258, as shown in FIG. 5, with the forward holes 254 providing access for a screwdriver bit. The two tracks can therefore be installed quickly and easily by placing the rearward sides of the flange and channel portions against the wall and inserting screws through the openings as described.

As can be seen with further reference to FIG. 5, the axle 248 of the lower rollers 242*a*, 242*b* is spaced forwardly of the axles of the upper rollers 240*a*, 240*b*. The rollers are also offset laterally, with the upper rollers 240*a*, 240*b* being spaced inwardly from the lower rollers 242*a*, 242*b*. The spacing enables the lower rollers to bear against the flange portions 252 of the rail members, while the upper rollers are received in the channel portions 250 and bear against the inside surfaces of the forward walls thereof. The upper rollers and upper frame bars thus resist vertical loads on the table and potter's wheel in tension, while the lower rollers and frame bars resist the forces in compression, providing a highly stable yet vertically adjustable assembly. The assembly is thus easily driven in a vertical direction by cooperation of the jackscrew (see FIG. 3) with a ball nut 260 that is mounted in the crossbar 262 between the upper frame bars.

Exemplary dimensions for the upper and lower rollers and track, as shown in FIG. 5 are as follows: channel width "a"—2 inches; upper roller diameter "b"—1.75 inches; lower roller diameter "c"—5 inches. Polyurethane rollers having the foregoing dimensions are eminently suitable for use in the embodiment that is illustrated. It will be understood, however, that other dimensions and other types and configurations of rollers may be utilized.

It is to be recognized that various alterations, modifications, and/or additions may be introduced into the constructions and arrangements of parts described above without departing from the spirit or ambit of the present invention.

What is claimed is:

1. An articulated potter's wheel assembly, comprising:

a frame having upper and lower sections;

a motor-driven wheel head mounted to said upper frame section;

means for selectively raising and lowering said upper frame section relative to said lower frame section, so as to adjust a height of said wheel head relative to a user; and means for selectively tilting said wheel head about a horizontal axis relative to said upper frame section so as to adjust an angle of said wheel head relative to a user.

2. The potter's wheel assembly of claim 1, further comprising:

a table member mounted to said upper frame section so as to be pivotable thereon about said horizontal axis, said table member having said wheel head mounted thereto.

3. The potter's wheel assembly of claim 2, wherein said means for selectively tilting said potter's wheel about said horizontal axis comprises:

a selectively extensible linear actuator having a first end that is mounted to said upper frame section and a second end that is mounted to a crank arm on mounted to said table member.

4. The potter's wheel assembly of claim 3, wherein said means for selectively raising and lowering said upper frame section comprises:

a jackscrew that operatively interconnects said upper and lower frame sections; and a motor mounted to said jackscrew for rotating said jackscrew in first and second directions so as to alternately raise and lower said upper frame section relative to said lower frame section.

5. The potter's wheel assembly of claim 4, wherein said jackscrew extends vertically between said upper and lower frame sections, a first end of said jackscrew being mounted to said motor on a one of said frame sections and a second end of said jackscrew being in cooperating engagement with an internally threaded member on the other of said frame sections.

6. The potter's wheel assembly of claim 2, further comprising:

a strap member for extending around and supporting the back of a user during operation of said assembly.

7. The potter's wheel assembly of claim 6, wherein said strap member comprises:

means for detachably connecting at least one end of said strap member to said upper frame assembly at a location proximate said horizontal axis about which said table member is pivoted.

8. The potter's wheel of claim 7, wherein said strap member further comprises:

means for supporting said strap member at a predetermined location across said user's back.

9. The potter's wheel assembly of claim 8, wherein said means for supporting said strap member at a predetermined location across said user's back comprises:

first and second hook-shaped suspension members that extend from said strap member for passing over said user's shoulders so as to suspend said strap member therefrom.

10. The potter's wheel assembly of claim 2, wherein assembly is configured for use as a free-standing unit, and wherein said lower frame section comprises:

a base portion for resting on a floor, said base portion extending beneath said table member on said upper frame section so as to stabilize said assembly against downward forces exerted on said table member.

11. The potter's wheel assembly of claim 10, wherein said base portion of said lower frame section comprises:

a substantially flat plate portion that is located generally beneath a front of said table so as to permit a wheelchair to pass thereover.

12. The potter's wheel assembly of claim 10, further comprising:

means for supporting said upper frame section for vertical movement on said lower frame section.

13. The potter's wheel assembly of claim 12, wherein said means for supporting said upper frame section for vertical movement on said lower frame section comprises:

at least one vertically-extending guide rod mounted to one of said frame sections; and at least one sleeve mounted to the other of said frame sections and having guide rod received in vertically sliding engagement therewith.

14. The potter's wheel assembly of claim 2, wherein said assembly is configured for use as a wall-mounted unit, and wherein said assembly further comprises:

means for supporting said upper frame section from a wall for vertical movement thereon.

15. The potter's wheel assembly of claim 14, wherein said means for supporting said upper frame section from a wall comprises:

at least one guide track that is mountable so as to extend vertically along said wall; and at least one roller that engages said guide track so as to support said upper frame section for vertical movement thereon.

16. The potter's wheel assembly of claim 15, wherein said at least one guide rail is mountable to a forward surface of said wall and said at least one roller is mounted to a rearward side of said upper frame section.

17. The potter's wheel assembly of claim 2, wherein said table member comprises:

a rigid, generally planar table having a motor and drive mechanism for said wheel head mounted to a lower side thereof.

18. The potter's wheel assembly of claim 17, wherein said table member further comprises:

means for detachably connecting said potter's wheel to said drive mechanism so that said wheel is selectively removable therefrom without use of tools.

19. The potter's wheel assembly of claim 18, wherein said means for detachably connecting said potter's wheel to said drive mechanism comprises:

a drive shaft that is mounted to said potter's wheel and extends downwardly therefrom so as to extend through said table; and a socket opening in said drive mechanism that receives said drive shaft in operative engagement therewith, so that said potter's wheel is selectively removable from said drive mechanism and said table member by lifting said wheel upwardly therefrom.

20. The potter's wheel assembly of claim 18, wherein said table member further comprises:

at least one recess formed in an upper side of said table for holding articles adjacent said wheel during use.

21. The potter's wheel assembly of claim 20, wherein said table member further comprises:

a removable tray for being placed on said table under said removable wheel, said tray having a recess that corresponds to said recess in said table so as to form an interfit therewith.

* * * * *